US005586876A

United States Patent [19]

Yasnnascoli et al.

[11] Patent Number: 5,586,876

[45] Date of Patent: Dec. 24, 1996

[54] ROTARY COMPRESSOR HAVING OIL PUMPED THROUGH A VERTICAL DRIVE SHAFT

[75] Inventors: Donald Yasnnascoli, Manlius, N.Y.; Alexander D. Leyderman, Frederick, Md.

[73] Assignee: Carrier Corporation, Syracuse, N.Y.

[21] Appl. No.: 552,662

[22] Filed: Nov. 3, 1995

[51] Int. Cl.[6] ..... F04C 18/356; F04C 23/00; F04C 29/02

[52] U.S. Cl. ..... 418/60; 418/88; 418/94; 418/96; 184/6.18

[58] Field of Search ..... 418/60, 88, 94, 418/96, 212; 184/6.18

[56] References Cited

FOREIGN PATENT DOCUMENTS 61-187587 8/1986 Japan ..... 418/94

64-73191 3/1989 Japan ..... 418/94

3-67092 3/1991 Japan ..... 418/88

*Primary Examiner*—John J. Vrablik

[57] ABSTRACT

In a high side, vertical, twin cylinder rolling piston hermetic compressor, a portion of the high pressure gas is diverted from the chamber defined by the lower muffler and the pump bearing to the axial bore of the crankshaft. The crankshaft extends into the oil sump such that rotation of the shaft produces a pumping action for pumping oil from the sump to structure requiring lubrication. Additionally, the flow diverted from the chamber to the axial bore produces a jet pump effect which supplements the pumping action produced by the rotating shaft, particularly at low speed.

6 Claims, 2 Drawing Sheets

ROTARY COMPRESSOR HAVING OIL PUMPED THROUGH A VERTICAL DRIVE SHAFT

BACKGROUND OF THE INVENTION

In vertical hermetic compressors it is a common practice to use the rotating shaft as a centrifugal pump for pumping lubricant from the sump to the locations requiring lubrication. To a degree, centrifugal pumps are speed dependent. With the wider use of variable speed motors, it is possible to operate a compressor in a speed range providing inadequate lubrication.

SUMMARY OF THE INVENTION

Because gas is discharged from the compression chamber against the bias of the discharge valve in combination with the fluid pressure in the muffler acting on the downstream portion of the discharge valve, the pressure of the gas passing through the valve port into the muffler can be on the order of 5 psi greater than anywhere else in the compressor. In the case of a two cylinder, vertical rolling piston or fixed vane hermetic compressor, one of the mufflers is secured to the pump side bearing and extends into the oil sump. Accordingly, the highest pressure gas is available at the oil sump. The present invention uses this highest pressure gas to assist in pumping lubricant. Specifically, a portion of the gas, discharging from the lower cylinder and carrying entrained oil, is directed to the bore in the shaft which serves as a centrifugal pump. The gas passing into the bore acts as a jet pump relative to the oil in the sump thereby supplementing the pumping action of the centrifugal pump for delivering lubricant to the structure requiring lubrication.

It is an object of this invention to improve lubrication at low speed operation.

It is another object of this invention to assist in pumping lubricant when a higher head is required due to a lowered sump level. These objects, and others as will become apparent hereinafter, are accomplished by the present invention. Basically, a portion of the compressed gas discharged from the bottom of a single cylinder vertical compressor or the lower cylinder of a vertical twin cylinder compressor is directed into the bore of the shaft which acts as a centrifugal pump. The portion of the gas directed into the bore coacts with the oil sump in the nature of a jet pump thereby assisting the centrifugal pump in pumping oil.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
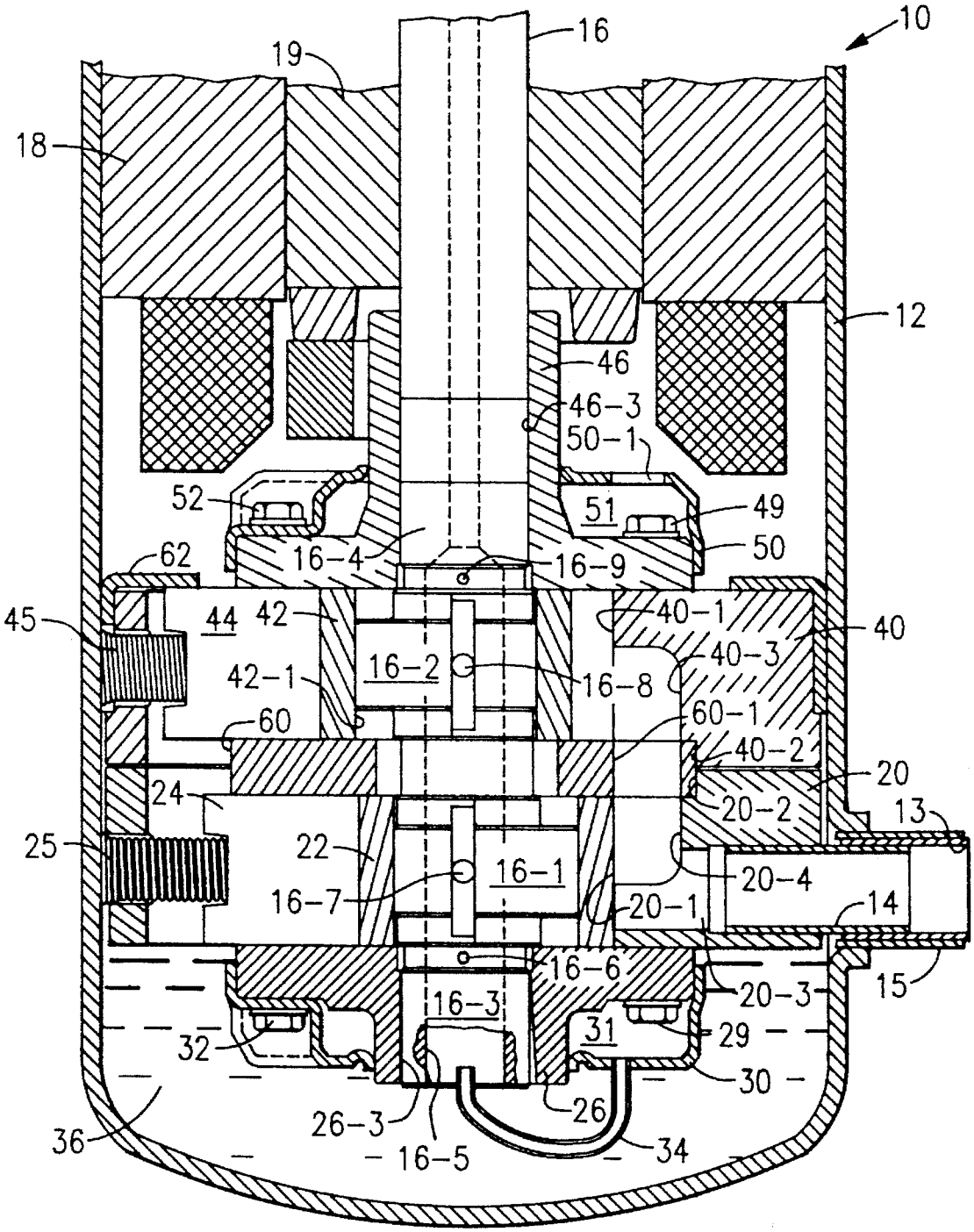
FIG. 1 is a partial, partially sectioned view of a vertical compressor employing the present invention.
Figure 2:
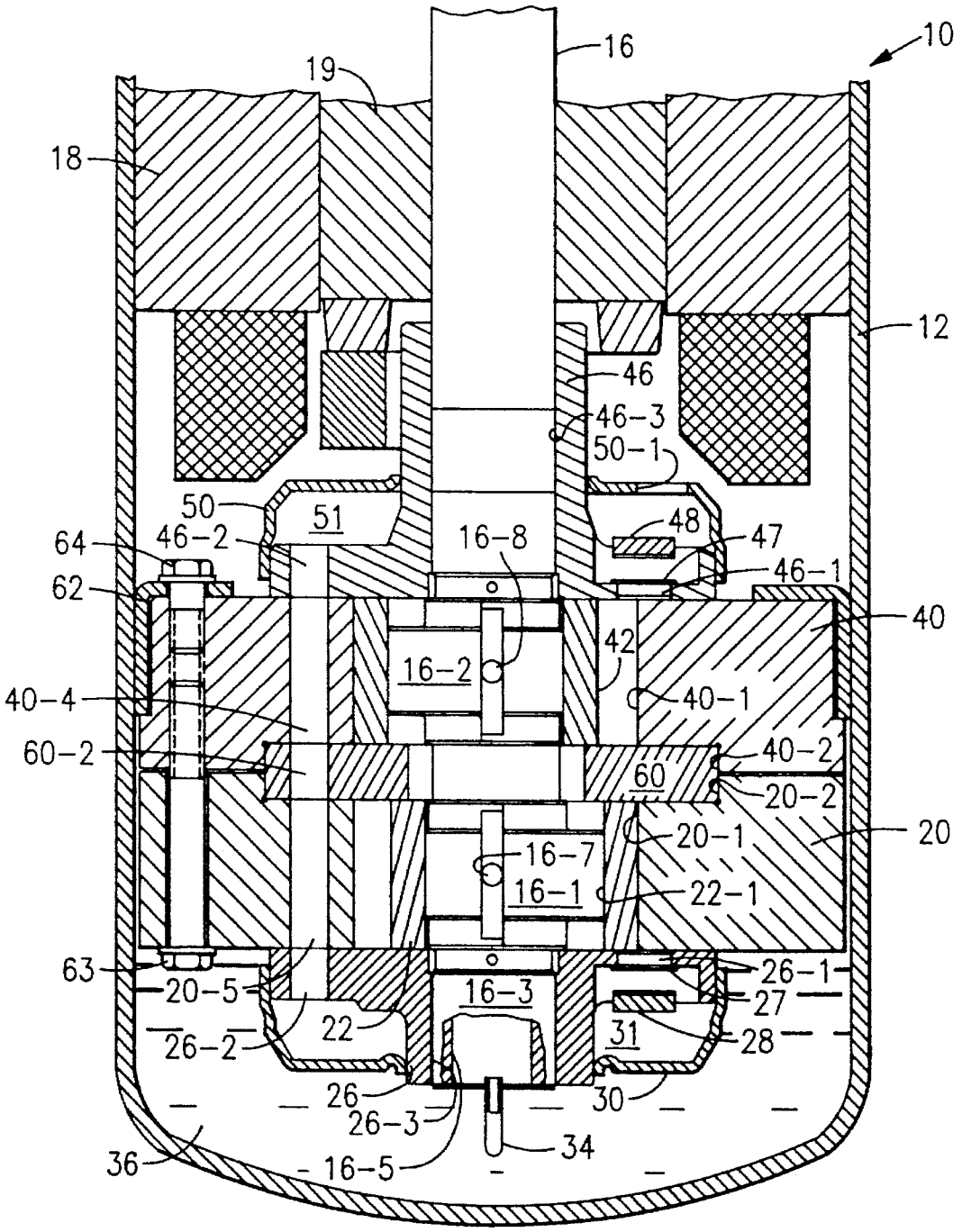
FIG. 2 is a partial, partially sectioned view taken about 90° from the view in FIG. 1.

In FIGS. 1 and 2, the numeral 10 generally designates a twin cylinder, high side, vertical, hermetic rolling piston compressor having a shell 12. There are two pump assemblies which, together, make up a pump cartridge. The first or lower pump assembly includes cylinder 20 which has a bore 20-1. Annular piston 22 is located in cylinder bore 20-1 and receives eccentric journal 16-1 of eccentric shaft 16 in bore 22-1. Vane 24 is located in a vane slot (not illustrated) and is biased into tracking contact with piston 22 by spring 25 and divides the crescent shaped clearance between piston 22 and bore 20-1 into a suction chamber and a discharge chamber. Pump bearing 26 underlies bore 20-1 and piston 22 while receiving the journal defining lower end 16-3 of shaft 16 in a bearing relationship. Pump bearing 26 is secured in place on cylinder 20 by a plurality of circumferentially spaced bolts 29. Discharge valve 27 and valve stop 28 are secured to bearing 26 such that discharge valve 27 coacts with valve stop 28 and discharge port 26-1 in pump bearing 26. Muffler 30 is secured to bearing 26 by bolts 32 and coacts therewith to define chamber 31. It should be noted that the only difference between bolts 29 and 32 is that bolts 32 additionally secure muffler 30 to bearing 26.

The second or upper pump assembly is similar to the first or lower pump assembly described above and includes cylinder 40 which has a bore 40-1. Annular piston 42 is located in cylinder bore 40-1 and receives eccentric journal 16-2 of eccentric shaft 16 in bore 42-1. Vane 44 is located in a vane slot (not illustrated) and is biased into tracking contact with piston 42 by spring 45, and, divides the crescent shaped clearance between piston 42 and bore 40-1 into a suction chamber and a discharge chamber. Motor bearing 46 overlies bore 40-1 and piston 42 while receiving the journal defining upper portion 16-4 of shaft 16 in a bearing relationship. Motor bearing 46 is secured in place on cylinder 40 by a plurality of circumferentially spaced bolts, 49 which correspond to bolts 29. Discharge valve 47 and valve stop 48 are secured to bearing 46 such that discharge valve 47 coacts with valve stop 48 and discharge port 46-1 in motor bearing 46. Muffler 50 is secured to bearing 46 by bolts 52 and coacts therewith to define chamber 51 which communicates with the interior of shell 12 via ports 50-1. It should be noted that the only difference between bolts 49 and 52 is that bolts 52 additionally secure muffler 50 to bearing 46.

Cylinders 20 and 40 are provided with recesses 20-2 and 40-2, respectively, which receive separator plate 60 therein. Plate 60 and pump bearing 26 provide sealed, lubricated contact, respectively, with the top and bottom of piston 22 and vane 24 while plate 60 and motor bearing 46 provide sealed, lubricated contact with the bottom and top, respectively, of piston 42 and vane 44. Additionally, plate 60 coacts with the recesses to radially locate the cylinders 20 and 40 with respect to each other, and to coaxially align the journal bearings 16-3 and 16-4 of shaft 16 with bearings 26 and 46.

In operation, compressor 10 is driven by an electric motor including stator 18, which is secured to shell 12, and rotor 19 which is secured to shaft 16 and which turns as a unit therewith. Rotation of shaft 16 produces a centrifugal pumping effect which draws oil from sump 36 into bore 16-5 and delivers it to feed passages 16-6 through 16-9 for lubricating the various members, as is conventional. The coaction of vanes 24 and 44 with pistons 22 and 42, respectively, creates a reduced pressure that tends to draw gas from the refrigeration or air conditioning system (not illustrated). Gas passes serially through suction line 13 and tube 14 into radial bore 20-3 which leads directly into bore 20-1. As is best shown in FIG. 1, radial bore 20-3 also connects with axial bore 20-4 and serially via axial bores 60-1 and 40-3 with bore 40-1. Gas compressed in cylinder 20, as best shown in FIG. 2, passes through port 26-1 into chamber 31. Gas from chamber 31 can pass through either of two paths into chamber 51 by axial bores in cylinder 20 and axial bores in cylinder 40. In the path illustrated in FIG. 2, compressed gas from chamber 31 serially passes through bores 26-2 and 20-5, 60-2, 40-4 and 46-2 into chamber 51. Gas compressed in cylinder 40 passes through port 46-1 into chamber 51. Gas from chamber 51 passes through ports 50-1 into the interior of shell 12 and out the discharge (not illustrated).

Additionally, according to the teachings of the present invention, a third flow path is provided from chamber 31 in muffler 30. Tube 34 is sealingly connected to muffler 30 and provides a fluid path from chamber 31 to bore 16-5 in shaft 16. During discharge, the gas pressure in the mufflers 30 and 50 is slightly higher, about 5 psi, than the pressure in shell 12 and is the cause of discharge pulsations. Discharge pulsations in muffler 30 cause a portion of the gas in muffler 30 to flow through tube 34 into bore 16-5 in shaft 16 thereby delivering substantial energy that assists the delivery of oil from sump 36 via bore 16-5 to feed passages 16-6 through 16-9. The passage of high pressure gas from tube 34 into bore 16-5 produces a jet pump effect with respect to the oil from sump 36. The actual contribution of the flow through tube 34 is a function of the motor speed, oil sump level, magnitude of pressure fluctuations, and specific pumping mechanism whether centrifugal, as illustrated, or positive displacement. However, the jet pump effect provides pumping assistance when it is most needed, at low speed operation.

Although a preferred embodiment of the present invention has been illustrated and described, other changes will occur to those skilled in the art. For example, the present invention is applicable to a single cylinder, high side, vertical roiling piston compressor. The major requirement is the presence of lower muffler 30, or its equivalent, and it is common to employ two mufflers in a single cylinder compressor for the additional sound reduction. Also, a single muffler could be used at the bottom of the cylinder, if necessary or desired. Additionally, a positive displacement pump may be used rather than a centrifugal pump and still obtain the benefits of the present invention. It is therefore intended that the scope of the present invention is to be limited only by the scope of the appended claims.

What is claimed is:

1. A vertical, high side, hermetic rotary compressor means comprising:

shell means;

pump assembly means located in said shell means;

motor means located in said shell means above said pump assembly means;

shaft means rotatably driven by said motor means and extending downwardly through said pump assembly means into an oil sump located in the bottom of said shell means;

said shaft means coacting with said pump assembly means to cause said pump assembly means to compress gas and including oil distribution means extending from said oil sump;

said oil distribution means including means for pumping oil from said sump into said oil distribution means;

bearing means secured to said pump assembly means and supportingly receiving said shaft means;

muffler means secured to said bearing means and coacting therewith to define a chamber in fluid communication with said pump assembly means via discharge valve means whereby gas compressed in said pump assembly means is supplied to said chamber;

a first fluid path for directing a majority of the compressed gas supplied to said muffler means into said shell means;

a second fluid path for directing a minor amount of the compressed gas supplied to said muffler means into said oil distribution means whereby the compressed gas passing into said oil distribution means coacts with said oil from said sump to produce a jet pump effect assisting to supply oil from said sump to said oil distribution means.

2. The compressor means of claim 1 wherein said oil distribution means includes a generally axially extending bore in said shaft means communicating with at least one radially extending bore communicating with said generally axially extending bore.

3. The compressor means of claim 1 wherein said second fluid path extends through a portion of said oil sump.

4. The compressor means of claim 1 wherein said pump assembly means includes an upper and a lower pump assembly.

5. The compressor means of claim 4 wherein said muffler means is secured to said lower pump assembly.

6. The compressor means of claim 5 further including muffler means secured to said upper pump assembly and forming a part of said first fluid path.

* * * * *